United States Patent [19]

Larsson

[11] Patent Number: 4,698,931

[45] Date of Patent: Oct. 13, 1987

[54] RIFLE BOLT MECHANISM AND SAFETY

[75] Inventor: Lars G. Larsson, Malung, Sweden

[73] Assignee: Lano Vapen och Finmekanik, Malung, Sweden

[21] Appl. No.: 833,384

[22] PCT Filed: May 3, 1985

[86] PCT No.: PCT/SE85/00196

§ 371 Date: Jan. 15, 1986

§ 102(e) Date: Jan. 15, 1986

[87] PCT Pub. No.: WO85/05172

PCT Pub. Date: Nov. 21, 1985

[30] Foreign Application Priority Data

May 4, 1984 [SE] Sweden ..... 8402425

[51] Int. Cl.[4] ..... F41C 7/00; F41C 17/08

[52] U.S. Cl. ..... 42/16; 42/70.01

[58] Field of Search ..... 42/16, 70.01

[56] References Cited

U.S. PATENT DOCUMENTS

| | | | |
|---|---|---|---|
| 3,387,400 | 6/1968 | Badali et al. | 42/70.01 |
| 3,710,492 | 1/1973 | Tirrell | 42/16 |
| 4,305,218 | 12/1981 | Godsey | 42/70.01 |
| 4,454,672 | 6/1984 | Timari | 42/16 |
| 4,547,988 | 10/1985 | Nilsson | 42/16 |

FOREIGN PATENT DOCUMENTS

| | | | |
|---|---|---|---|
| 759051 | 12/1950 | Fed. Rep. of Germany | 42/16 |
| 2212934 | 9/1973 | Fed. Rep. of Germany | 42/16 |
| 519 | of 1901 | United Kingdom | 42/16 |

*Primary Examiner*—David H. Brown
*Assistant Examiner*—Michael J. Carone
*Attorney, Agent, or Firm*—Cushman, Darby & Cushman

[57] ABSTRACT

A breech bolt firearm in which the bolt is mounted turnably but axially immovable in a guide sleeve is improved by placing a projection on part of the bolt which when aligned with a longitudinal recess provided on the sleeve allows dismantling of the breech bolt mechanism. Also a safety is provided which latches both the firing pin nut and the bolt handle.

10 Claims, 15 Drawing Figures

RIFLE BOLT MECHANISM AND SAFETY

The present invention relates to a rifle bolt mechanism of the turning bolt action type where the bolt is movable relative a breech mechanism and by turning is lockable in the firing position in the breech mechanism, and where a firing pin united with a firing pin nut is arranged in the bolt, which is provided with a handle for operation, the firing pin nut being mounted non-rotatably but axially displaceably in a guide sleeve, which in turn is displaceably mounted in the breech mechanism.

A well-known example of this type of rifle bolt mechanism is the Mauser mechanism. One of the disadvantages with this type of mechanism is that the guide for the bolt is very short, which causes the axial movements of the bolt in the breech mechanism to be jerky as a result of the bolt coming out of alignment. This makes handling the weapon more difficult, inter alia for marksmanship shooting.

To obtain a better guidance of the bolt, it has been proposed in the Swedish published specification No. 339 645 to mount a guiding fork rearward of the breech mechanism for guiding the bolt. However, such a mounting fork makes the weapon more complicated and also requires extra space. Furthermore, precision will not be as good as when the improved guide is incorporated in the mechanism to start with.

The object of the invention is to provide an improved rifle bolt mechanism where the bolt is very well guided in the breech mechanism. A further object of the invention is to provide a bolt mechanism which is simple and reliable from the aspects of manufacture and maintenance.

These objects are achieved in accordance with the invention by the volt being mounted turnably but axially immovably in the guide sleeve and being guided in the breech mechanism via the guide sleeve. The bolt is suitably guided here in the guide sleeve along the major portion of its length, and a particularly advantageous embodiment is obtained if the forward end of the guide sleeve, when the bolt is in the firing position, reaches substantially as far as the forward end of the breech mechanism cartridge opening.

By both the firing pin nut and bolt being accommodated in the guide sleeve, it can be made very long. This results in that the bolt is given very good axial guidance, thus obtaining a smooth and comfortable action, without any binding tendency. Furthermore, the bolt is given very good mounting for rotation, with the consequence that its forward end may be given an exact locking position reltive the cartridge position, which is essential for precision weapons.

Further distinguishing features and advantages of the invention will be perceived from the following description and claims.

The invention will now be described in detail with the aid of an embodiment illustrated on the accompanying drawing, where:

Figure 1:
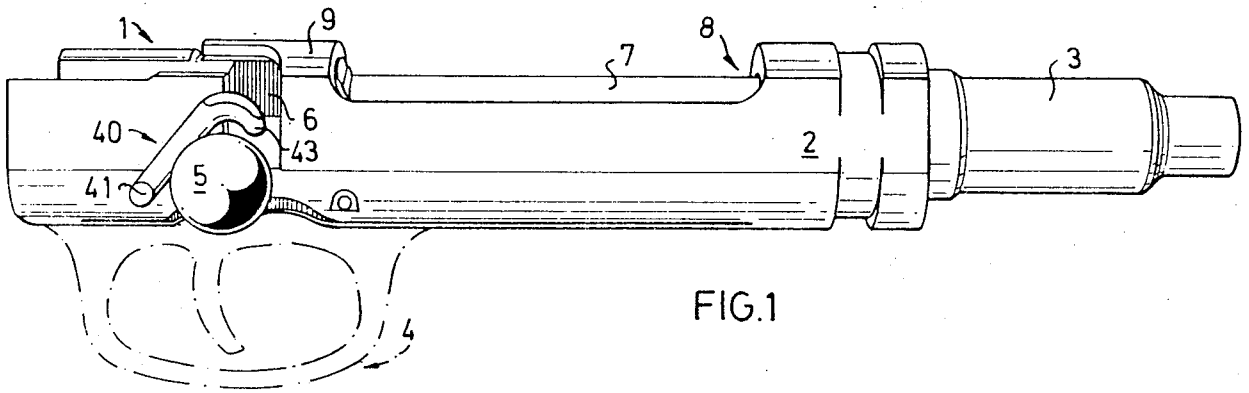
FIG. 1 is a side view of a breech mechanism where a bolt mechanism in accordance with the invention is shown in the firing position.
Figure 2:
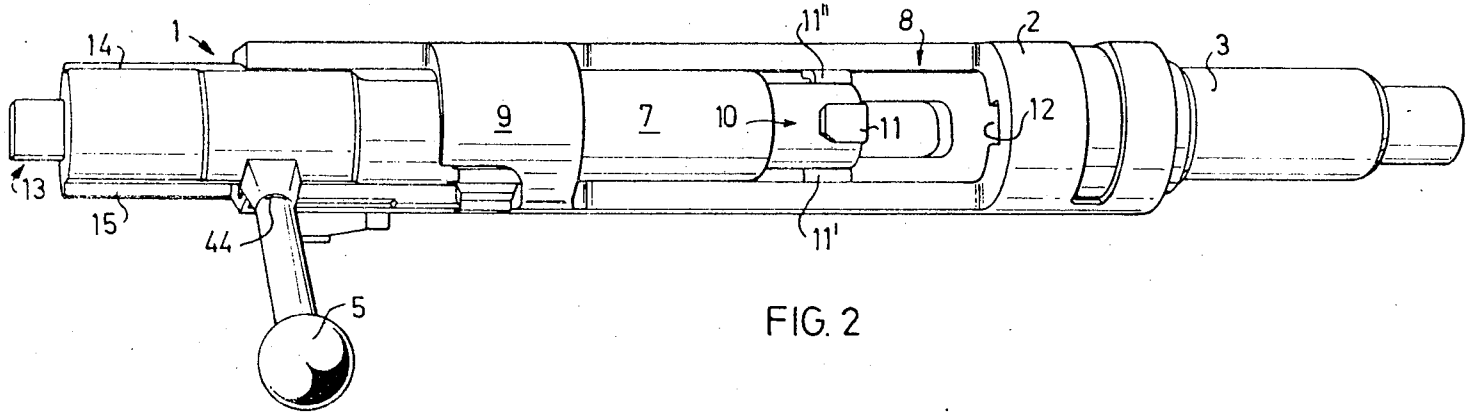
FIG. 2 is a view from above of the breech mechanism in FIG. 1, with the bolt mechanism in a partially withdrawn position.

In an inventive rifle bolt mechanism, as is apparent from FIGS. 1 and 2, a breech mechanism 1 is displaceably mounted in a breech mechanism 2, the forward end of which is attached to a barrel 3. The breech mechanism 2 is intended to be provided on its underside with a triggering arrangement 4, which may be of conventional type, and therefore does not need to be described in detail in this connection.

In FIG. 1 the bolt mechanism is illustrated in its forward position with the bolt handle 5 pushed down in a transverse slot 6 in the breech mechanism 2. A guide sleeve 7 enclosed in the bolt mechanism 1 then reaches with its forward end up to the same position as the forward end of the cartridge opening 8 of the breech mechanism. The cartridge opening 8 is backwardly defined by an upper cross piece 9 on the breech mechanism 2.

In the situation illustrated in FIG. 2, the bolt handle 5 has been turned upwards out of the slot 6, the bolt mechanism 1 then having been moved backwards some way with the aid of the handle 5. During turning and the axial movement of the bolt 10 with the aid of its handle 5, locking abutments 11 forwards on the bolt 10 have been moved in complementary locking grooves 12 situated forwards in the breech mechanism 2 so that the bolt 10 is no longer locked in the firing position. The bolt 10 is mounted in the guide sleeve 7 and is guided during its axial movement by the breech mechanism 2 via the guide sleeve 7. A firing pin nut 13, also included in the bolt mechanism 1 is mounted in the guide sleeve 7 as well as the bolt 10. When the handle 5 is turned upwards from the position illustrated inFIG. 1 to that illustrated in the position 2, the bolt mechanism 1 will be spring-biassed, the nut 13 being moved backwards in the guide sleeve 7, as will be described in detail later. The guide sleeve 7 is provided along its sides with longitudinal guide ridges 14 and 15, moving in complemental grooves in the breech mechanism 2.

By moving the bolt mechanism 1 fully backwards from the position illustrated in FIG. 2, and after releasing required latches, the bolt mechanism 1 can be completely removed from the breech mechanism 2. A bolt mechanism 1, just removed from the breech mechanism 2, is illustrated inFIG. 3. As will be seen, the bolt 10 is guided in the guide sleeve 7 for the major part of its length. On the rearward part of the bolt 10 there is a cam profile 16 co-acting with a biassing tooth 17 on the firing pin nut 13. The cam profile 16 is formed such that on turning the bolt handle 5 from the position illustrated in FIG. 1 to that in FIG. 2, it urges the biassing tooth 17, and thereby also the nut 13, rearwards so that the bolt mechanism is spring-biassed and the firing pin nut 13 assumes the firing position. When the mechanism 1 is then moved forwards in the breech mechanism, a support surface 18 on the firing pin nut 13 will be brought into engagement with the triggering arrangement 4 and prevent the forward movement of the nut 13. The handle 5 can then be turned down into the position illustrated in FIG. 1 without the nut 13 moving forwards.

Figure 4:
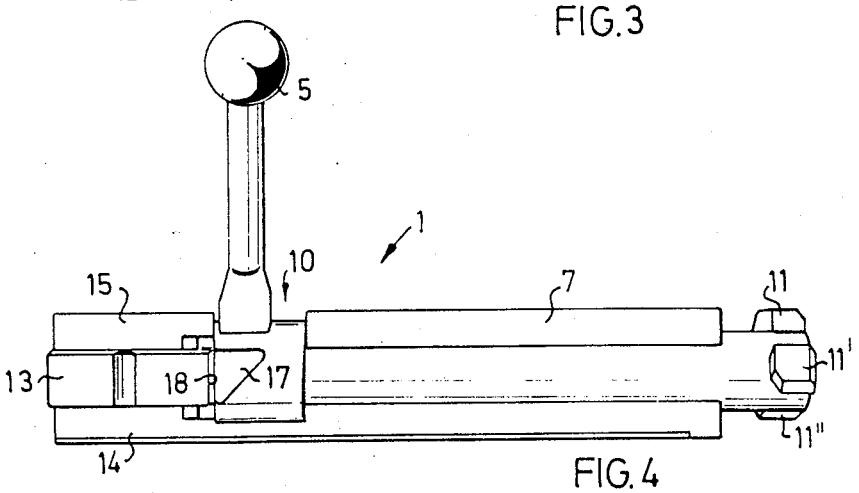
FIG. 4 is a view from below of the bolt mechanism of FIG. 3 after firing.

On firing, latching from the triggering arrangement 4 against the support surface 18 ceases, and the parts in the bolt mechanism 1 assume the relative positions illustrated in FIG. 4, where the firing pin 13 is in a position moved forwards relative the guide sleeve 7. The bolt mechanism 1 is seen from below in FIG. 4.

Figure 5:
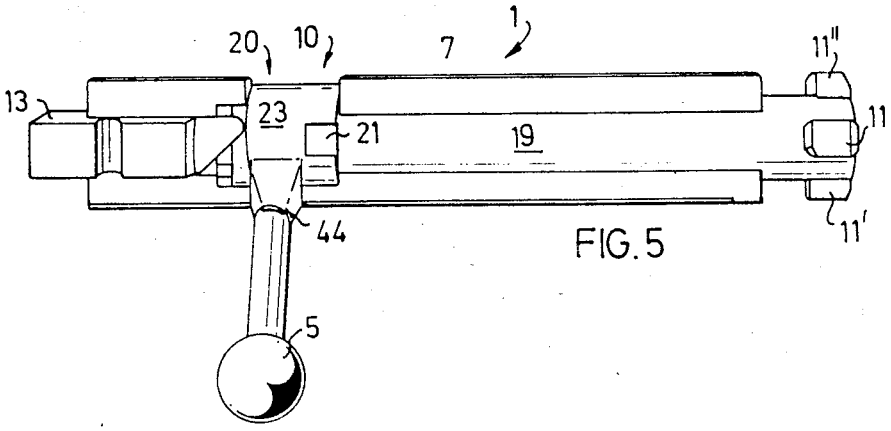
FIG. 5 is the same view as in FIG. 4 but with the bolt mechanism ready for dismantling.

By moving the firing pin nut 13 backwards a sufficient length, from the position illustrated inFIG. 4 and against bias from the firing pin spring, the bolt 10 may be turned to the position illustrated in FIG. 5, in which the bolt mechanism 1 may be dismantled. The bolt 10 comprises a first part 19 and a second part 20, which are non-rotatably attached to each other in an assembled condition. The first part 19 is elongate and has a circular cross-section. At its forward end it carries the locking abutments 11 and at its rearward end it is provided with a radial projection 21 for engagement in a recess 22 (see FIG. 6) in the forward end of a sleeve 23 included in the second part 20, the first part 19 being inserted in the sleeve 23. The bolt mechanism 1 can now be taken apart by pulling the first part 19 forwards out of the guide sleeve 7. The remaining second part 20 together with the firing pin nut 13 may then be lifted out of the guide sleeve.

The bolt mechanism 1 is illustrated in an entirely dismantled state in FIG. 6, where the different parts are illustrated with the same orientation as in FIG. 5. As will be seen from FIG. 6A, the guide sleeve 7 is provided with a circumferential locking groove 24, the width of which corresponds to the length of the sleeve 23. As will have been understood already, this locking groove 24 has an opening on the underside of the guide sleeve which is sufficiently large for the sleeve 23 to be inserted into the locking groove 24 from the underside of the guide sleeve 7. There is a recess 25 in one wall of the guide sleeve 7 for enabling the necessary rotation of the second part 20. The locking groove 24 is forwardly defined by a support surface 26, the radial extension of which substantially corresponds to the material thickness of the sleeve 23 and the radial extension of the radial projection 21 on the first part 19. The first part 19 is locked axially forwards in relation to the guide sleeve 7 when the radial projection 21 is in contact with the support surface 26. A second radial support surface 27 restricts the locking groove 24 rearwards and is intended to co-act with the rear end of the sleeve 23 for locking the first part 19 axially backwards via the radial projection 21. The guide sleeve 7 has a bore 28 intended for the first part 19. In connection with the bore 28 there is a first longitudinal recess 29 for the radial projection 21 of the first part 19. In this case the first recess 29 comprises a slot arranged on the underside of the guide sleeve 7, the width of the slot being less than the diameter of the bolt first part 19. Behind the locking groove 24 there is a second recess 30 in the guide sleeve 7 for the firing pin nut 13, the recess having the form of a longitudinal open slot towards the underside of the guide sleeve. In this slot there is a support surface 31 facing towards the forward end of the guide sleeve.

Figure 6A:
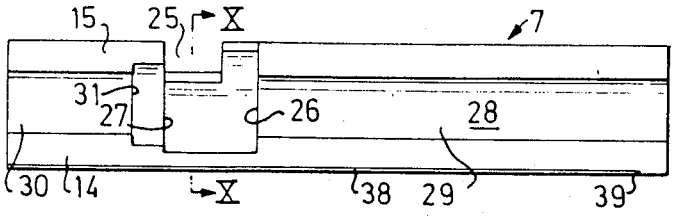
FIG. 6 illustrates the bolt mechanism in FIG. 5 in a dismantled state.
Figure 6B:
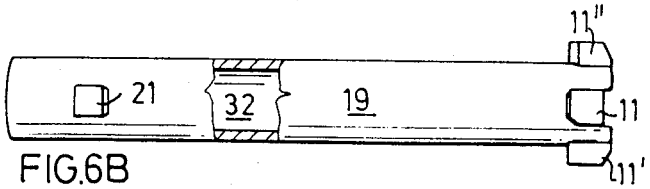
Figure 6C:
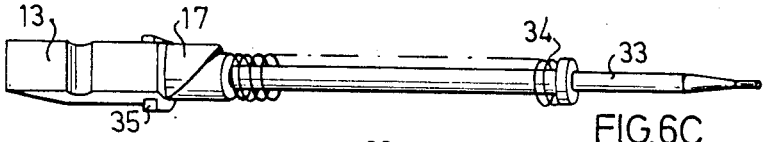
Figure 6D:
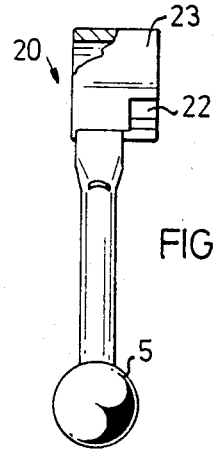

As will be seen from FIG. 6B, the first part 19 of the bolt is provided with an elongate hole 32 for the firing pin 33 and associated spring 34, illustrated in FIG. 6C. The firing pin 33 is rigidly connected to the firing pin nut 13 and carries a displaceably mounted support member 35 biassed by the firing pin spring 34, the member 35 thus being movable relative the nut 13. In an assembled state, this support member 35 is intended to be in contact with the support surface 31 in the guide sleeve 7.

Figure 7:
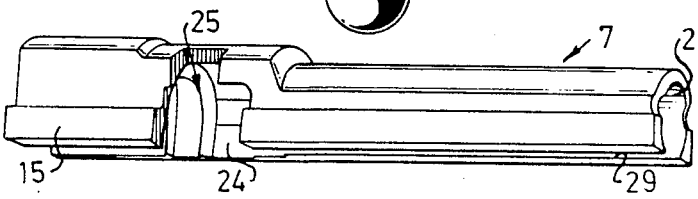
FIG. 7 is a perspective view of the guide sleeve.
Figure 8:
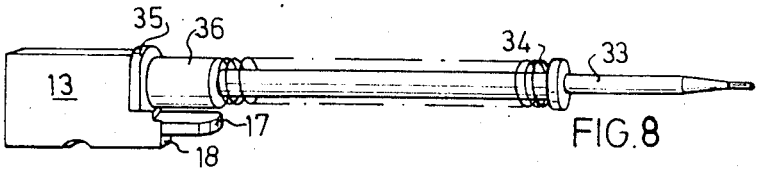
FIG. 8 is a perspective view of the firing pin with its associated nut.

Further details in the embodiment of the guide sleeve 7 will be seen from FIG. 7. The implementation of the firing pin nut 13 and the support member 35 relatively movable thereto will be seen from FIG. 8. A cylindrical portion 36 on the support member 35 is intended to fit into the hole 32 in the bolt first part 19.

Figure 9:
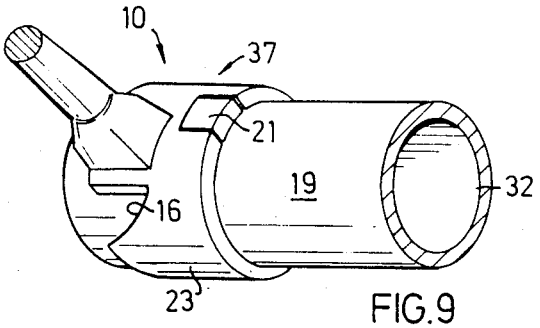
FIG. 9 is a perspective view of a detail of the bolt.

As will be seen in better detail from FIG. 9, the radial projection 21 on the first part 19, together with the sleeve 23 in the second part of the bolt, forms a radial locking means 37 intended for accommodation in the locking groove 24 in the guide sleeve 7. The turning lock between the sleeve 23 and the first part 19 can of course be formed in a plurality of other ways than what has been illustrated here.

Figure 10:
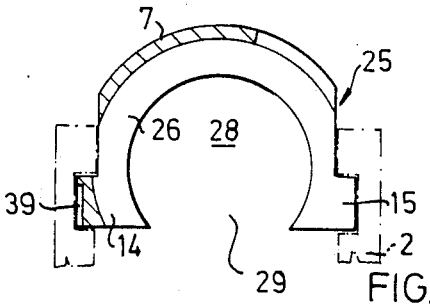
FIG. 10 is a section along the line X—X in FIG. 6.

As will be seen from FIG. 10, the guide ridges 14 and 15 on the guide sleeve 7 are accommodated in corresponding grooves in the breech mechanism 2. Good guidance may be obtained merely with the aid of the guide ridges and the grooves, but it is also possible further to improve the guidance by allowing the walls of the guide sleeve to co-act with the walls of the breech mechanism. Furthermore,the locking abutments 11' and 11'' on the bolt can to advantage have a shape and location such that they run in the same grooves as the guide ridges 14 and 15 when the bolt 10 is moved axially in the breech mechanism.

The rifle mechanism illustrated here should naturally be supplemented by such details as shell extractor and shell ejector. For the sake of clarity these details have been left out, but their embodiment should not cause one skilled in the art any problems, since a large number of usable solutions exist.

The sleeve 23 included in the second part 20 of the bolt 10 can be precision-cast to advantage, machining of the cam profile 16 thus being eliminated. Since the first part 19 of the bolt also has a simple shape, manufacture of the bolt itself is considerably simplified, this otherwise being often complicated and expensive. By the simple locking determined by its form between the guide sleeve 7 and the part mounted in it, there are avoided complicated arrangements for mutual locking between the parts. In the embodiment illustrated here, the first recess 29 comprises a slot in the guide sleeve, but it is also quite possible to have a depression in connection with the bore 28 instead of a slot, and thus have a guide sleeve closed on the underside, at least at the first part 19 on the bolt 10.

By its mounting in the guide sleeve 7, the bolt 10 obtains very good guidance in the breech mechanism 2, both for axial and rotational movement. In turn this means that the bolt always has a well-defined firing position in the breech mechanism, which is important for shooting accuracy. This good guidance also enables smooth and comfortable handling of the bolt mechanism.

Figure 3:
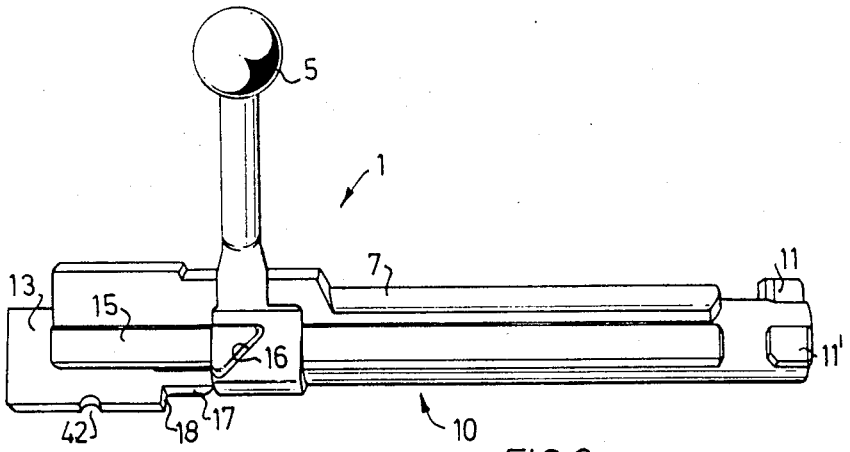
FIG. 3 is a side view of the bolt mechanism in accordance with the invention in the state it is in after being spring-biassed.

To assemble the bolt mechanism, the bolt second part 20 is first thrust over the firing pin 33 with the recess 22 facing toward the tip of the pin. The firing pin nut 13 is then placed in the second recess 30 in the guide sleeve 7, while the bolt second part 20 is placed in the locking groove 24, with the recess 22 oriented in extension to the first recess 29. The bolt first part 19 is then thrust into the bore 28 with the radial projection 21 accommodated in the first recess 29. After the radial projection 21 has moved into the recess 22 in the sleeve 23 and the different parts of the bolt mechanism assume the positions indicated in FIG. 5, the bolt is twisted in the guide sleeve 7 such that the different parts of the bolt mechanism assume the positions illustrated in FIG. 3. The bolt mechanism 1 can now be inserted in the breech mechanism 2.

As will be seen from FIG. 6B and FIG. 10, there is a longitudinal recess 38 in the guide ridge 14 on the guide sleeve 7, this recess being defined by an abutment surface 39 at the forward end of the guide sleeve. The recess 38 is intended for abutment means (unillustrated) arranged in the breech mechanism 2 such as to arrest, in co-action with the abutment surface 39, the backward movement of the guide sleeve when the bolt mechanism has attained a fully withdrawn position.

Figure 11A:
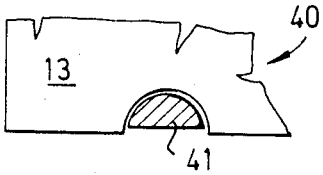
FIG. 11 illustrates the function of a safety device.
Figure 11B:
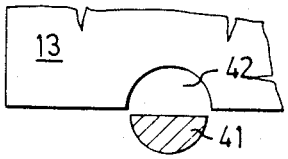

The bolt mechanism can be provided with different types of safety devices. For example, it is possible to mount a safety bolt intended for co-action with the firing pin nut 13 in the guide sleeve 7. Special advantages can, however, be achieved with a safety device 40 (FIG. 1) illustrated on the drawing, where a safety bolt 41 is rotatably mounted in the breech mechanism 2 for co-action with a recess 42 (FIG. 11) arranged in the firing pin nut 13. In the safety position, FIG. 11A, the safety bolt 41 is in engagement with the recess 42, thus latching against movement of the firing pin nut. At the same time, according to Fig 1, a locking poriton 43 in the form of a tip on the operating portion of the safety bolt 41 is in engagement with a stop means 44, suitably a groove, on the handle 5 such that turning the handle upwards is prevented when the bolt mechanism is on safety. After turning the safety bolt 41 away from its safety position, FIG. 11B, firing and turning up of the handle 5 may take place.

I claim:

1. A rifle bolt mechanism of the turning bolt action type, wherein a bolt, which is provided with a handle, along the major part of its length is mounted rotatably but axially undisplaceably in a guide sleeve, which guide sleeve guides the bolt in a breech mechanism, and wherein a firing pin united with a firing pin nut cooperates with the bolt, which bolt at its forward end is provided with locking abutments for fixing the bolt in the firing position in the breech mechanism, said bolt comprising an elongate first part and a second part carrying said handle, said first and second parts being formed for non-rotatable connection to each other, and there being provided in the guide sleeve an annular locking groove for the bolt at the rear end of a bore for said first part of the bolt, characterized in that in the guide sleeve there extends between its forward end and the locking groove a first longitudinal recess for a radial projection at the rear of said first part of the bolt, said radial projection being adapted to engage the locking groove, which in the underside of the guide sleeve has an opening via which a second sleeve included in said second part of the bolt can be radially inserted into said locking groove, whereby the first part of the bolt, after axial insertion into the guide sleeve and into the second sleeve inserted into the guide sleeve, may be turned together with the second part of the bolt in the guide sleeve to rotatably hold the bolt in the guide sleeve.

2. Rifle bolt mechanism as claimed in claim 1, characterized in that the second part (20) is provided with a biassing cam profile (16) for the firing pin nut (13).

3. Rifle bolt mechanism as claimed in claim 1, characterized in that the first longitudinal recess (29) comprises a slot arranged on the underside of the guide sleeve (7), the width of the slot being less than the diameter of the bolt first part (19).

4. Rifle bolt mechanism as claimed in claim 3,, characterized in that the width of the slot (29) is greater than the diameter of the firing pin spring (34), whereby the firing pin nut (13) with associated firing pin (33) and firing pin spring (34) can be taken in and out of the guide sleeve (7) radially, with the sleeve (23) in the bolt second part (20) pushed over the firing pin.

5. Rifle bolt mechansim as claimed in 1, characterized in that the guide sleeve (7) has a second recess (30) intended for the firing pin nut (13) and arranged behind the locking groove (24), the recess (30) preferably having the form of a longitudinal open slot on the underside of the guide sleeve.

6. Rifle bolt mechanism as claimed in claim 5, characterized in that there is a support surface (31) in the second recess (30) facing towards the forward end of the guide sleeve for a support member (35), displaceable relative the firing pin nut (13) mounted on the firing pin (33) and biassed by the firing pin spring (34).

7. Rifle bolt mechanism as claimed in claim 1, characterized in that the guide sleeve (7) is provided with longitudinal guide ridges (14,15) for co-action with complementary guide grooves in the breech mechanism (2), whereby a guide ridge (14) is extending on one side of the guide sleeve along the entire length of the guide sleeve, while on the other side of the guide sleeve the corresponding guide ridge (15) has an interruption at the position (25) for the bolt handle (5).

8. Rifle bolt mechanism as claimed in claim 7, characterized in that locking abutments (11',11'') on the bolt (10) are arranged to be accommodated in the same grooves as the guide ridges (14,15).

9. Rifle bolt mechanism as claimed in claim 1, characterized in that the bolt handle (5) may be turned down into a recess (6) at the rear part of the breech mechanism (2) flush with a rear, upper cross piece (9) thereon.

10. Rifle bolt mechanism as in claim 1 including a safety means comprising a safety bolt which is mounted in the breech mechanism and which in its safety position is arranged to latch both the firing pin nut and the bolt handle.

* * * * *